US005967436A

United States Patent [19]

Balvanz

[11] Patent Number: 5,967,436

[45] Date of Patent: Oct. 19, 1999

[54] PRODUCTION PLUS HAMMER WITH PROTECTIVE POCKET

[76] Inventor: Loran Russell Balvanz, 104 N. Main St., New Providence, Iowa 50206

[21] Appl. No.: 09/092,198

[22] Filed: Jun. 5, 1998

[51] Int. Cl.[6] ..... B02C 13/04

[52] U.S. Cl. ..... 241/291; 241/195; 241/197; 241/300

[58] Field of Search ..... 241/291, 195, 241/197, 300

[56] References Cited

U.S. PATENT DOCUMENTS

| | | | |
|---|---|---|---|
| Re. 24,806 | 4/1960 | Christainsen | 241/186 |
| 1,761,083 | 6/1930 | Liggett . | |
| 2,986,347 | 5/1961 | Stevenson | 241/191 |
| 3,680,797 | 8/1972 | Covey | 241/73 |
| 3,906,035 | 9/1975 | Allen et al. | 241/32 |
| 3,929,296 | 12/1975 | Stoeber | 241/197 |
| 4,136,833 | 1/1979 | Knight | 241/194 |
| 4,161,294 | 7/1979 | Lautenschlager et al. | 241/56 |
| 4,162,770 | 7/1979 | Lewis | 241/191 |
| 4,915,309 | 4/1990 | Schmidt | 241/191 |
| 5,022,593 | 6/1991 | Stelk | 241/194 |
| 5,285,974 | 2/1994 | Cesarini | 241/194 |
| 5,307,719 | 5/1994 | MacLennan | 83/839 |
| 5,320,292 | 6/1994 | Smith | 241/191 |
| 5,720,440 | 2/1998 | Bonner et al. | 241/101.761 |

*Primary Examiner*—Joseph J. Hail, III
*Assistant Examiner*—William Hong
*Attorney, Agent, or Firm*—Daniel A. Rosenberg; Kent A. Herink; Doris Brown

[57] ABSTRACT

A hammer comprising a hammer body. The hammer body comprises a rotor forming portion with a trailing and a leading edge and is capable of securement to a rotor, a tip support section capable of extending into a debris path, and a production pocket extending from the leading edge of the rotor portion also capable of extending into the debris path. The hammer also comprises a hammer tip secured to the tip section of the hammer body and at least partially shielded from the debris path by the production pocket of the hammer body.

10 Claims, 4 Drawing Sheets

PRODUCTION PLUS HAMMER WITH PROTECTIVE POCKET

BACKGROUND OF THE INVENTION

The invention relates generally to a hammer attachable to a hammermill, or a tub grinder, or the like. More specifically, the invention relates to a hammer with the hammer body formed to extend the useful life of a rotatable hammer tip.

Impact crushers, like rotary hammermills or tub grinders, or the like, of the type contemplated herein, are widely used to size reduce objects into smaller fragments through rotation of a motor driven rotor. These devices typically include a plurality of hammers attached to the rotor, which strike the debris thereby causing the size reduction. The prior art describes uses of two piece hammers that comprise a hammer body and a rotatable hammer tip (see U.S. Pat. No. 5,285,974). Utilizing the rotatable hammer tip comprises a quick and convenient means for replacing an impacting working edge of the hammer tip. When the working edge of the hammer tip wears out, the hammer tip simply rotates through removal of securement bolts enabling operation to continue.

While the working edge of the hammer tip receives the brunt of the impacting force, the non-working edge of the hammer tip often comes into substantial residual contact with the debris. This can reduce the effective life of the non-working edge by anywhere from 25 to 50 percent or more. In other words, residual deflected contact with debris by the non-working edge of the hammer tip unnecessarily exposes the non-working edge of the rotatable hammer tip to wear and tear, and shortens the life of the non-working edge after rotating the rotatable hammer tip. This essentially reduces the life of a rotatable hammer tip, increases the cost of operation, and increases down time by requiring more frequent replacement of the rotatable hammer tips. Additionally, residual impact can also damage the securement bolts that attach the rotatable hammer tip to the hammer body.

Accordingly, for the foregoing reasons, a need exists for a hammer that utilizes a rotatable hammer tip that reduces premature wear and tear on the non-working edge of the hammer tip.

SUMMARY OF THE INVENTION

An object of the present invention comprises extending the useful life of a hammer tip by protecting a portion of the hammer tip from a debris path.

These and other objects of the present invention will become apparent to those skilled in the art upon reference to the following specification, drawings, and claims.

The present invention intends to overcome the difficulties encountered heretofore. To that end, the present invention involves a hammer comprising a hammer body. The hammer body comprises a rotor forming portion with a trailing and a leading edge and is capable of securement to a rotor, a tip support section capable of extending into a debris path, and a production pocket extending from the leading edge of the rotor portion also capable of extending into the debris path. The hammer also comprises a hammer tip secured to the tip section of the hammer body and at least partially shielded from the debris path by the production pocket of the hammer body.

DETAILED DESCRIPTION OF THE INVENTION

Figure 1B:
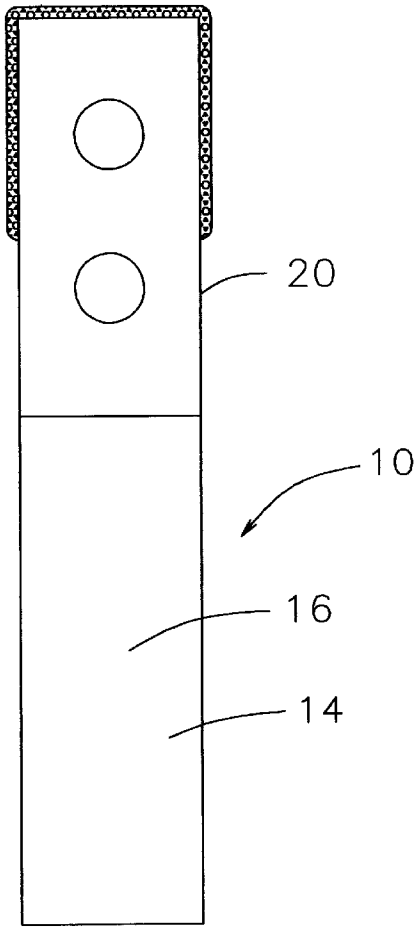
FIG. 1*b* is a side elevation view of the prior art hammer body of FIG. 1*a*.
Figure 1A:
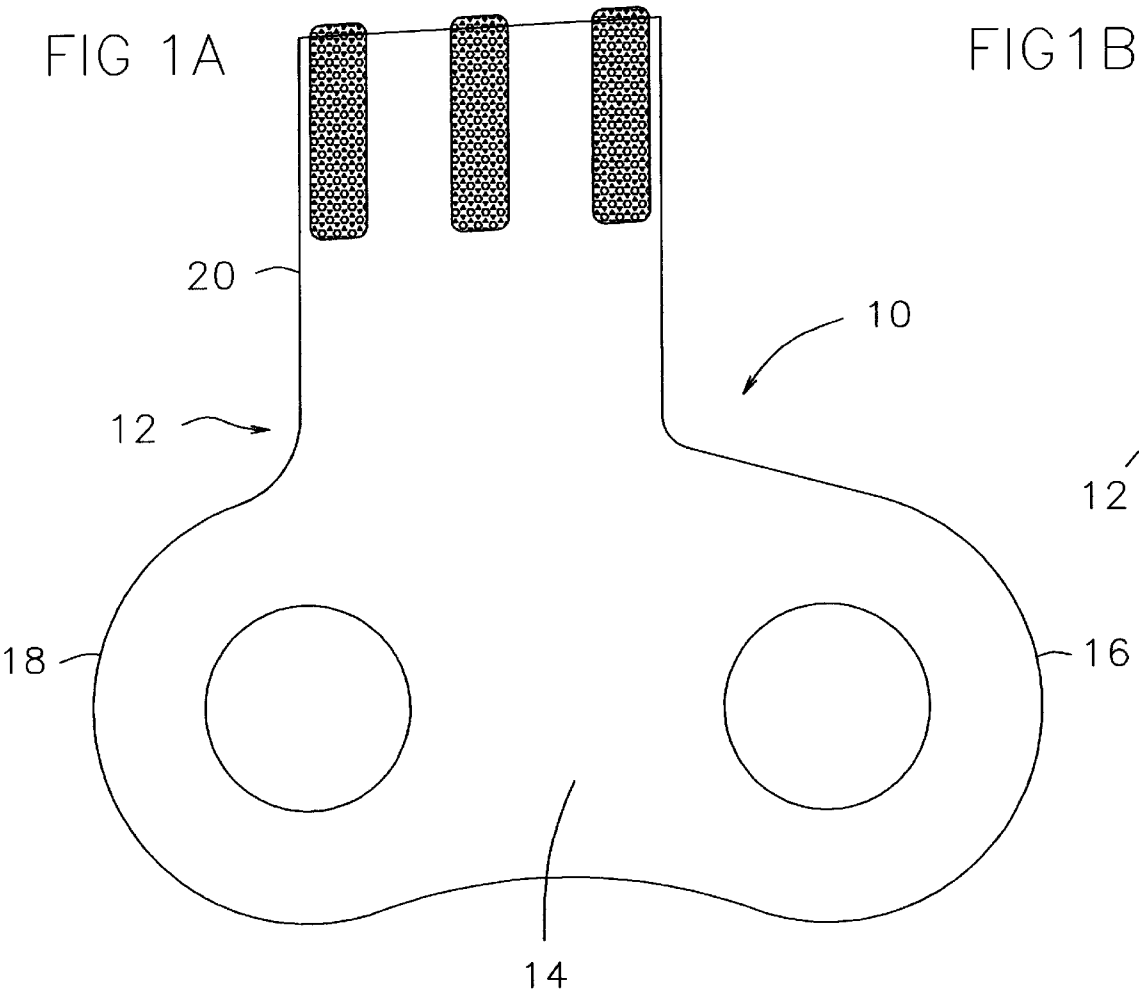
FIG 1A PRIOR ART
FIG. 1*a* is a front elevation view of a prior art hammer body.
Figure 2:
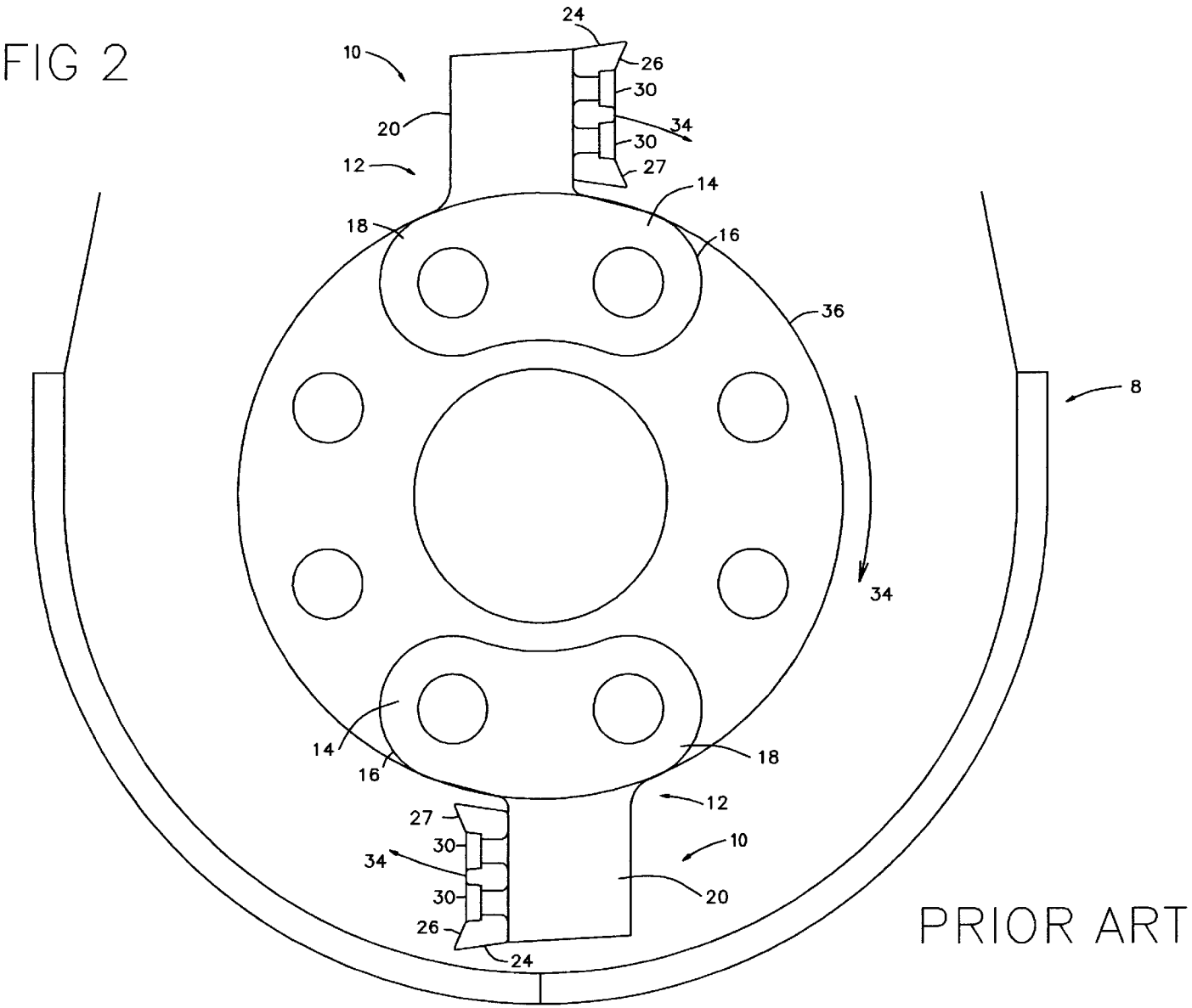
FIG. 2 is a top plan view of a prior art impact crusher.

In the drawings, FIGS. 1-2 show an example of a prior art hammer 10 and a prior art impact crusher 8. The impact crusher 8 consists of a motor driven rotor 36, which drives plurality of hammers 10. The hammer 10 in turn comprises a hammer body 12 with a rotor forming portion 14 capable of securement to the rotor 36. Additionally, the rotor forming portion 14 comprises a leading edge 16, and a trailing edge 18. The hammer body 12 of the hammer 10 configures in such a manner that the leading edge 16 of the rotor forming portion 14 orients in the direction of the axis rotation 34 of the rotor 36. The rotatable hammer tip 24 contains a working edge 26 and a non-working edge 27. The rotatable hammer tip 24 secures to the tip support portion 20 of the hammer body 12 through securement bolts 30.

FIG. 2 clearly shows that during operation the rotation of the rotor 36 exposes both the working edge 26 and the non-working edge 27 of the hammer tip 24 to contact with the debris. Furthermore, securement bolts 30 also lie directly in the debris path. Configured in this manner, the hammer 10 of the prior art impact crusher 8 suffers from the disadvantage of premature wear of the non-working edge 27 of the rotatable hammer tip 24, and possible degradation and damage to the securement bolts 30.

Figure 3B:
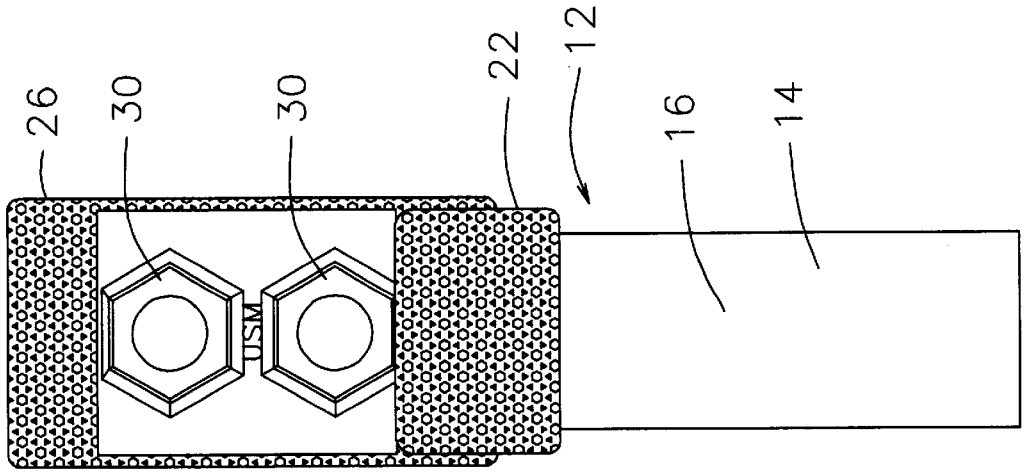
FIG. 3*b* is a side elevation view of the hammer of FIG. 3*a*.
Figure 3A:
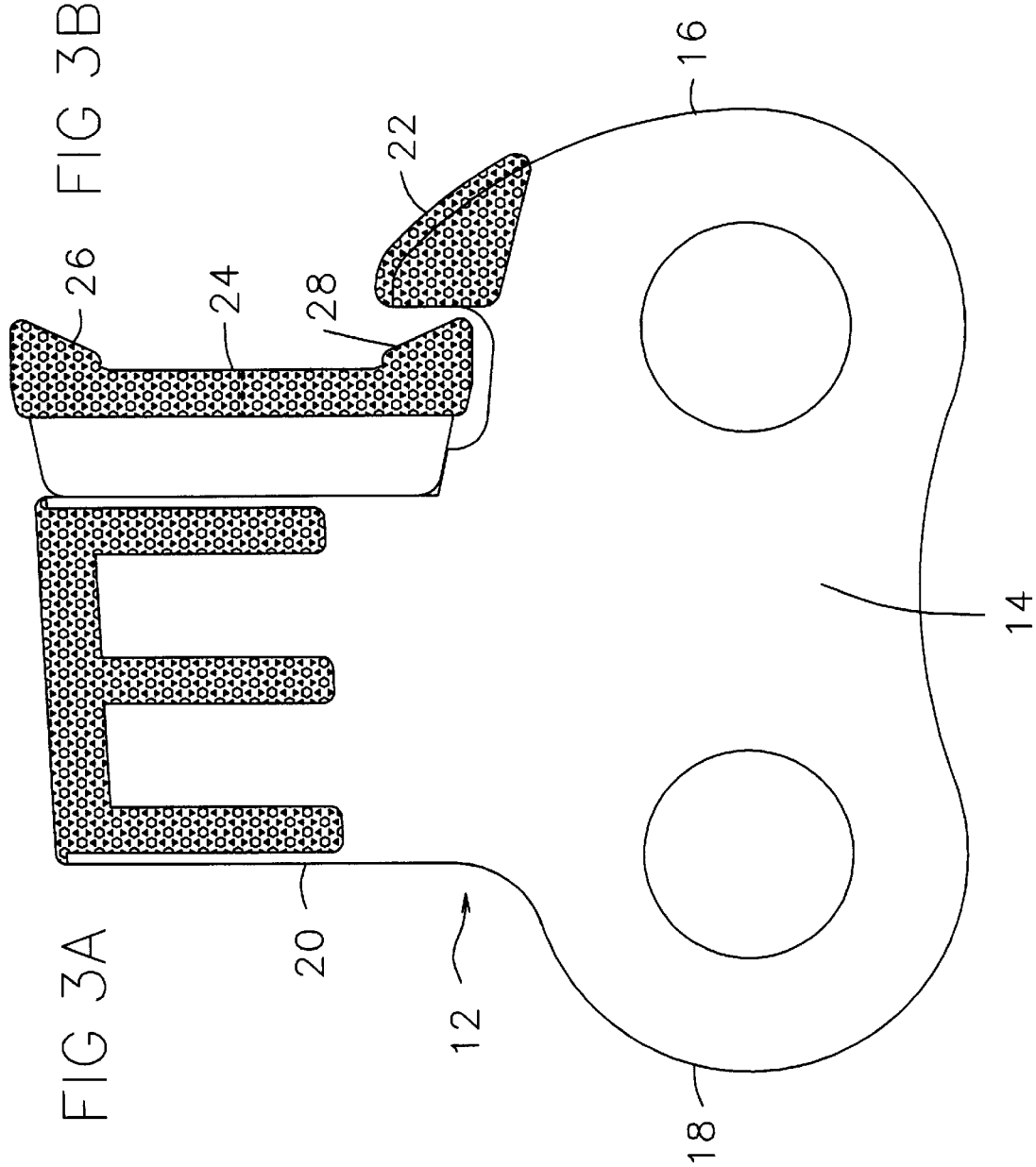
FIG. 3*a* is a front elevation view of a hammer.
Figure 4:
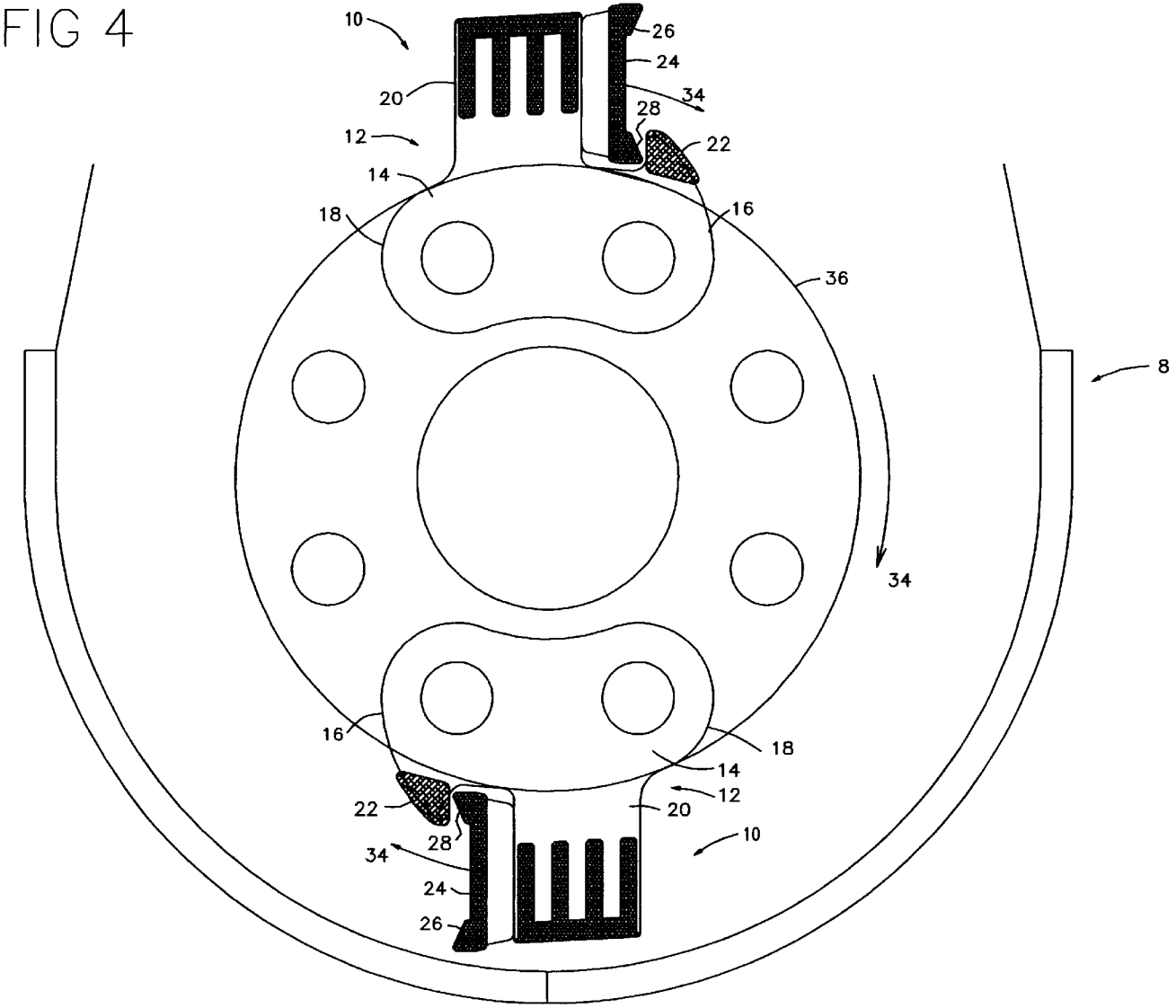
FIG. 4 is a top plan view of a prior art impact crusher.

FIGS. 3-4 show the apparatus of the present invention. The present invention comprises an impact crusher 8, comprising a motor driven rotor 36 and a plurality of hammers 10 securable to the rotor 36. The hammer comprises a hammer body 12, which further comprises a rotor forming portion 14 and a tip support portion 20. The rotor forming portion 14 of the hammer body 12 further comprises a leading edge 16 and a trailing edge 18. The rotor forming portion 14 of the hammer body 12, however, differs substantially from the prior art in that the leading edge 16 of the rotor forming portion 14 contains a production pocket 22. The production pocket 22 extends upward from the leading edge 16 into the debris path a distance great enough to protect a portion of the rotatable hammer tip 24. In this manner, the rotatable hammer tip 24 contains a working edge 26, fully exposed to the debris path and a protected edge 28. The protected edge 28 of the rotatable hammer tip 24 rests behind the production pocket 22, and out of the debris path. Additionally, FIG. 3*b* shows that the width of the production pocket 22 is substantially equal to a width of the rotatable hammer tip 24. This allows the production pocket 22 to better deflect debris from the protected edge 28 of the rotatable hammer tip 24. Furthermore, the production packet 22 also deflects debris thereby reducing the contact of debris with the securement bolts 30. The production pocket 22 is coated with wear resistant coating, indicated in FIGS. 3-4 by the shaded region, in order to protect the production pocket 22 upon contact with the debris. In the preferred embodiment of the invention the wear resistant coating of the production pocket 22 comprises tungsten carbide.

Configured in the manner shown, the hammer 10 substantially eliminates wear and tear on the protected edge 28 of the rotatable hammer tip 24 through adapting the hammer body 12 to include the production pocket 22. The production pocket 22 by deflecting debris away from the protected edge 28 of the rotatable hammer tip 24, and away from securement bolts 30 substantially increases the useful life of the rotatable hammer tip 24. By increasing the useful life of the rotatable hammer tip 24 the production pocket 22 also reduces the cost, and down time associated with the operation of impact crushers 8.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing form the scope of the invention.

I claim:

1. A hammer secured to a rotor of a rotary hammermill formed to extend the useful life of a hammer tip, said hammer comprising:

a) a hammer body secured to the rotor of the rotary hammermill comprising:

i) a rotor forming portion capable of securement to a rotor, said rotor portion having a leading edge and a trailing edge;

ii) a tip support portion capable of extending into a debris path upon securement of said rotor portion of said hammer to said rotor; and iii) a production pocket affixed to said leading edge of said rotor portion of said hammer body, extending into said debris path upon securement of said rotor portion of said hammer to said rotor, whereby said production pocket extends into said debris path from said leading edge of said rotor portion of said hammer body, and wherein said production pocket is replaceable upon the replacement of said hammer body;

b) a rotatable hammer tip having a working edge and a protected edge secured to said tip support portion of said hammer body, wherein said hammer tip is at least partially shielded from said debris path by said production pocket of said hammer body.

2. The invention in accordance with claim 1 wherein said working edge and said protected edge of said hammer tip are coated with a wear resistance coating.

3. The invention in accordance with claim 2 wherein said wear resistance coating comprises tungsten carbide.

4. The invention in accordance with claim 1 wherein said production pocket is coated with a wear resistance coating.

5. The invention in accordance with claim 4 wherein said wear resistance coating comprises tungsten carbide.

6. The invention in accordance with claim 1 wherein said hammer tip secures to said tip support portion of said hammer body with at least one securement bolt.

7. The invention in accordance with claim 6 wherein said production pocket of said hammer body extends into said debris path enough to protect said securement bolt.

8. The invention in accordance with claim 1 wherein said hammer tip is rotatable about an axis substantially tangent to an axis of rotation.

9. The invention in accordance with claim 1 wherein a width of said production pocket is substantially equal to a width of said hammer tip.

10. A hammer secured to a rotor of a rotary hammermill formed to extend the useful life of a hammer tip, said hammer comprising:

a) a hammer body secured to the rotor of the rotary hammermill comprising:

i) a rotor forming portion capable of securement to a rotor, said rotor portion having a leading edge and a trailing edge;

ii) a tip support portion capable of extending into a debris path upon securement of said rotor portion of said hammer to said rotor; and iii) a tungsten carbide coated production pocket affixed to said leading edge of said rotor portion of said hammer body, extending into said debris path upon securement of said rotor portion of said hammer to said rotor, wherein said production pocket extends into said debris path from said leading edge of said rotor portion of said hammer body, and wherein said production pocket is replaceable upon the replacement of said hammer body; and b) a rotatable hammer tip having a working edge and a protected edge secured to said tip support portion of said hammer body with at least one securement bolt wherein said securement bolt is at least partially shielded from said debris path by said production pocket, wherein said hammer tip has a tungsten carbide coated working edge and a tungsten carbide coaled protected edge is at least partially shielded from said debris path by said production pocket of said hammer body, and said hammer tip is rotatable about an axis substantially tangent to an axis of rotation, and wherein a width of said production pocket is substantially equal to a width of said hammer tip.

* * * * *

UNITED STATES PATENT AND TRADEMARK OFFICE

Certificate

Patent No. 5,967,436 Patented: October 17, 1999

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Loran R. Balvanz and Paul R. Gray.

Signed and Sealed this Ninth Day of April 2002.

ALLEN M. OSTRAGER
*Acting Supervisory Patent Examiner*
Art Unit 3725

UNITED STATES PATENT AND TRADEMARK OFFICE

CERTIFICATE OF CORRECTION

PATENT NO. : 5,967,436
DATED : October 17, 1999
INVENTOR(S) : Loran R. Balvanz and Paul R. Gray It is certified that error appears in the above-identified patent and that said Letters Patent is hereby corrected as shown below:

Title page,
Item [75], Inventors, please correct inventorship to read -- Loran R. Balvanz and Paul R. Gray --

Signed and Sealed this

Twenty-third Day of April, 2002

*Attest:*

*Attesting Officer*

JAMES E. ROGAN
*Director of the United States Patent and Trademark Office*